United States Patent [19]

Bates et al.

[11] Patent Number: 4,543,981

[45] Date of Patent: Oct. 1, 1985

[54] SLIDING GATE VALVES

[75] Inventors: Kenneth W. Bates, Chesterfield; Norman H. Watts, Sheffield, both of England

[73] Assignee: USS Engineers & Consultants, Inc., Pittsburgh, Pa.

[21] Appl. No.: 427,350

[22] Filed: Sep. 29, 1982

[30] Foreign Application Priority Data

Nov. 26, 1981 [GB] United Kingdom ..... 8135745
Nov. 26, 1981 [GB] United Kingdom ..... 8135746

[51] Int. Cl.[4] ..... F16K 43/00

[52] U.S. Cl. ..... 137/315; 137/375; 222/598; 222/599; 251/196; 251/302; 266/236

[58] Field of Search ..... 137/315, 454.2, 454.6, 137/375; 251/170, 178, 195, 196, 148, 152, 177, 178, 302, 303, 327, 328; 222/597, 598, 599, 600; 266/236

[56] References Cited

U.S. PATENT DOCUMENTS

| | | | |
|---|---|---|---|
| 1,842,056 | 1/1932 | Westling | 251/302 |
| 1,998,080 | 4/1935 | Gerlich | 251/302 |
| 2,591,429 | 4/1952 | Harrower | 251/178 |
| 2,661,770 | 12/1953 | Hookham | 251/302 |
| 2,661,771 | 12/1953 | Hookham | 251/302 |
| 2,781,787 | 2/1957 | Johnson | 251/302 |
| 3,343,562 | 9/1957 | Combes | 137/315 |
| 3,430,644 | 3/1969 | Lyman | 222/598 |
| 3,659,822 | 5/1972 | Nagy | 251/178 |
| 3,764,047 | 10/1973 | Inoue et al. | 222/598 |
| 3,837,356 | 9/1974 | Selep et al. | 251/302 |
| 3,912,134 | 10/1975 | Doran | 222/598 |
| 3,921,866 | 11/1975 | Palazzo | 222/598 |
| 3,981,482 | 9/1976 | Callahan, Jr. et al. | 251/148 |
| 4,056,217 | 11/1977 | Aliprandi et al. | 222/600 |

FOREIGN PATENT DOCUMENTS

| | | | |
|---|---|---|---|
| 209147 | 12/1955 | Australia | 251/302 |
| 767267 | 1/1957 | United Kingdom | 251/302 |
| 2052703 | 1/1981 | United Kingdom | 222/598 |
| 2102544 | 2/1983 | United Kingdom | 222/598 |

*Primary Examiner*—George L. Walton
*Attorney, Agent, or Firm*—John F. Carney

[57] ABSTRACT

In order to resist alteration of the spring forces utilized for applying seal pressure between the valve bodies in sliding gate valves for molten metal pouring, particularly those of the manually operated type, the valve support plate and the mounting plate are arranged to form a narrow slot that receives the valve actuator and presents insufficient clearance to permit excessive relative displacement between the valve members. The valve further incorporates releasable attachments, two of which serve as hinge connections for the support plate while the other serves as a latching member. Each of the attachments comprise clevis-mounted eyebolts in which the clevises have predetermined dimensions to establish a fixed, pre-set distance between the plates upon reassembly of the valve after opening and thus insure repeatability of the spatial relationships between the valve bodies and, concomitantly, of the seal pressure between the members.

6 Claims, 5 Drawing Figures

SLIDING GATE VALVES

BACKGROUND OF THE INVENTION

The present invention concerns improvements in sliding gate valves for use in the pouring of molten metals.

Such valves are well established in the art and normally include a set of orificed refractory valve bodies which are maintained in mutual face-to-face contact with such contact being assisted by the biasing effect produced by springs for pressing the bodies together. The valve bodies are relatively movable to place the orifices in the respective bodies either into or out of registry with one another in order to control the flow of molten metal through the valve.

For the proper functioning of such valves, it is necessary that the seal pressure developed by the spring-biased contact between the plates be accurately and consistently applied. If the spring forces are too low, metal may creep between the contact faces of the valve bodies resulting in leakage or breakout of molten metal at considerable risk to the safety of workers in the area as well as to the integrity of the valve and the costly refractory valve bodies therein. Should the spring forces be set too high, the springs may be overstressed and the valve bodies distorted or otherwise degraded.

The accuracy of the application of seal pressure between the refractory valve bodies is adversely affected, especially in small gate valves of the kind normally operated manually to which the present invention has particular application, by the possibility of a foundryman to mishandle a valve actuator, which may comprise a lengthy crowbar, in such a way that he to some degree overcomes the spring force urging the valve bodies into leak-tight contact. It is also adversely affected by the need for frequent disassembly of such valves for purposes of inspecting and/or renewal of worn valve bodies in which extreme care must be taken in re-setting the spring forces upon restoration of the valve to its former operating condition.

It is toward the solution of the aforementioned problems therefore that the present invention is directed.

SUMMARY OF THE INVENTION

Accordingly, there is provided a sliding gate valve for use in the pouring of molten metals comprising a mounting plate, a support plate and at least two orificed refractory valve bodies spring-pressed into sealing facial contact with one another, one of the valve bodies, which serves as a gate, being mounted in a frame pivoted to the support plate for arcuate to-and-fro movement about an axis parallel to the flow opening through the valve for opening and shutting the valve to metal flow, and the support plate carrying spring means which thrust the downstream one of the valve bodies against the other.

According to one aspect of the invention, the mounting plate and the support plate are arranged to form a narrow slot through which an actuating lever portion of the frame extends, the slot slidingly receiving the lever portion and coacting therewith to resist inadvertent displacements of the frame-mounted valve body.

According to another aspect of the invention, the two plates are secured together by releasable attachment devices which maintain a pre-set spacing between the plates, the attachments serving as hinges and clamps respectively and the latter, when released, permitting the plates to be swung apart for inspection or replacement of the valve bodies, each attachment comprising a clevis on one plate to which is pinned an eyebolt for passing through the other plate, the clevises being of predetermined dimensions such that, when nuts on the eyebolts are tightened to draw the plates together, abutment of the clevises with the said other plate results in attainment of the said pre-set spacing and in re-attainment of a previously set spring-bias after restoration of the valve to its operative state.

Use of the aforesaid attachments ensures that the slot width remains sensibly constant and this is important for guarding against inadvertent mishandling likely to encourage leaking. The said attachments are beneficial in another respect in that, through them, it is possible to dismantle and reassemble the valve repeatedly, e.g. for inspecting its wearable parts, without losing the pre-set level of spring biasing.

The invention is applicable to valves having two or three valve bodies, as well as to valves having linearly-movable and rotationally movable gates. In the latter case, the movable valve body can be held in a frame located between the said two plates, the frame being pivoted to the support plate for swinging movement about an axis parallel to a flow channel through the valve.

The valve can have two confronting, stationary valve bodies between which the slidably movable valve body is sandwiched, the frame therefor being disposed between the mounting and support plates.

Advantageously, the valve has a plurality of the said attachments spaced about the peripheries of the two plates, and at least one of the attachments serves as a hinge linking the plates when companion attachments are released.

Each attachment can comprise a clevis on one plate having an eyebolt pinned thereto which passes through the other plate and has a fastener engaging the latter screwthreaded thereon, and the said other plate has a distance piece thereon for abutment by the clevis, the clevis and distance piece being of predetermined dimensions for determining the pre-set spacing between the plates when the attachment is secured.

Spring means for the valve can comprise a plurality of spring devices each having one or more compressed spring units acting between the support plate and a force-transmitting rocker mounted thereon and abutting the said one valve member.

Conveniently, the force exerted by each spring device is changeable independently of the others by adjustment of the mounting securing its rocker to the support plate.

The invention comprehends a metal pouring vessel fitted with a valve according to the invention.

BRIEF DESCRIPTION OF THE DRAWINGS

The invention will now be described in more detail by way of example only with reference to the accompanying drawings, in which.

Figure 1:
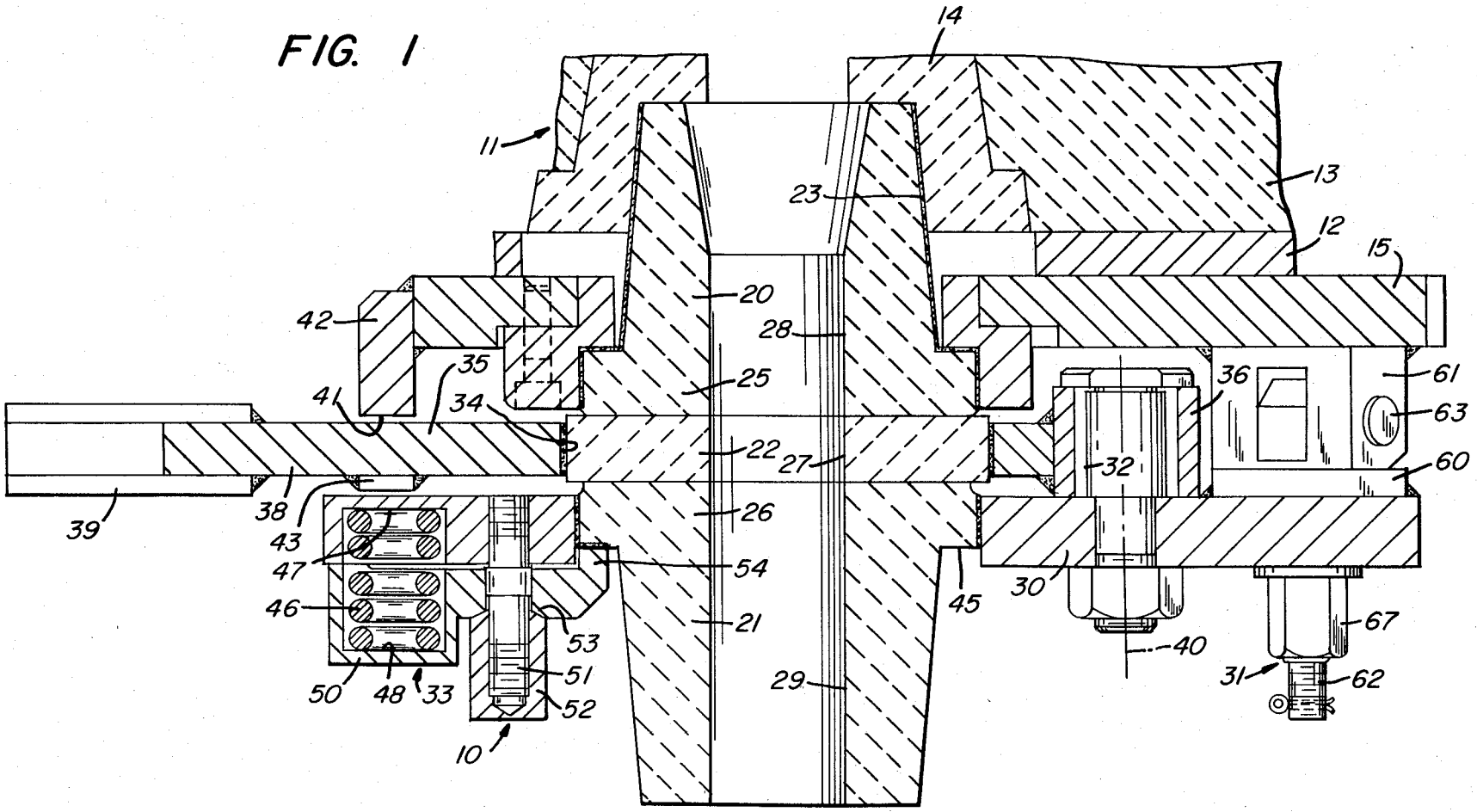
FIG. 1 is a sectional view through a rotary valve according to the invention.

The illustrated valve now to be described is referred to as a "rotary" valve for convenience, although rotational movements are limited arcuate swings which may, for instance, be to and fro within 45°.

The rotary valve 10 is for controlling flow of molten metal from a bottom pour ladle 11 or intermediate vessel such as a tundish. Vessel 11 has a steel casing 12 and an insulating lining 13 containing an orificed outlet brick 14. The lining 13 and outlet brick 14 can be of any convenient form and material as known in the art and will not be described further in detail.

The valve has a top mounting plate 15 by which it is secured with bolts, not shown, to the bottom of the vessel casing 12. Structure to be described, carried beneath the mounting plate, serves to support three orificed refractory valve members 20, 21 and 22 in operative engagement with one another.

Figure 2:
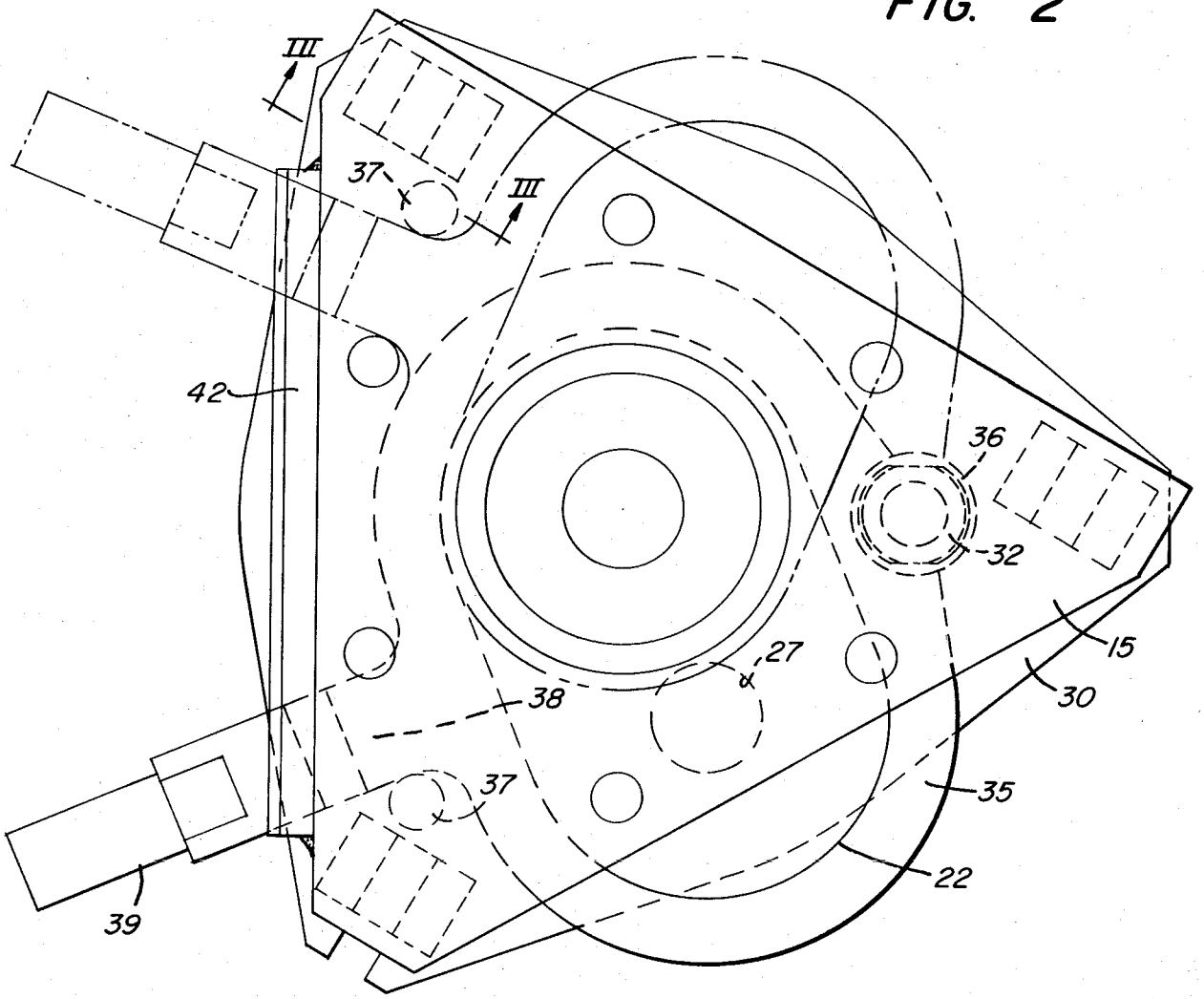
FIG. 2 is a diagrammatic plan view of the valve shown in FIG. 1.
Figure 3:
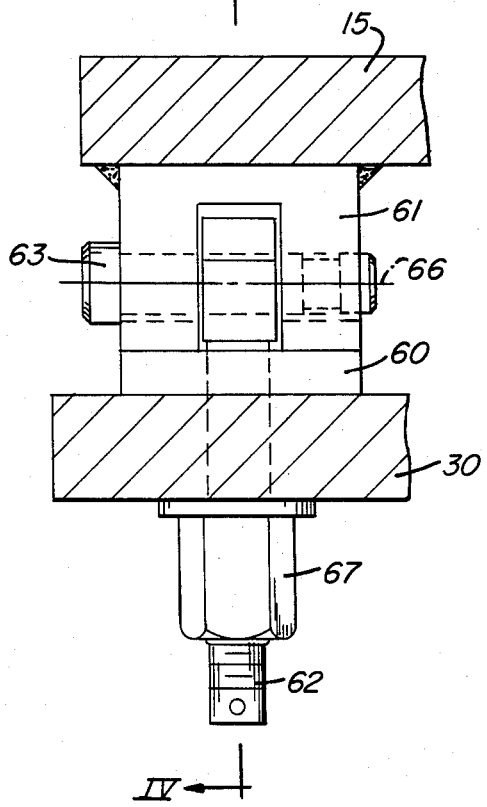
FIG. 3 is a sectional view on the line III—III of FIG. 2.
Figure 4:
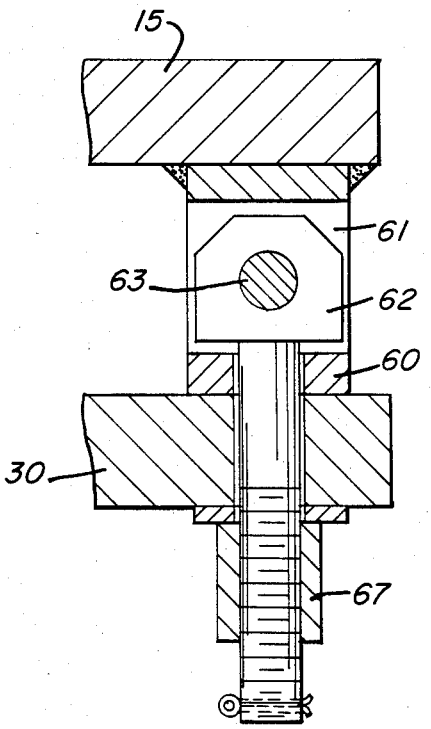
FIG. 4 is a sectional view on the line IV—IV of FIG. 3.
Figure 5:
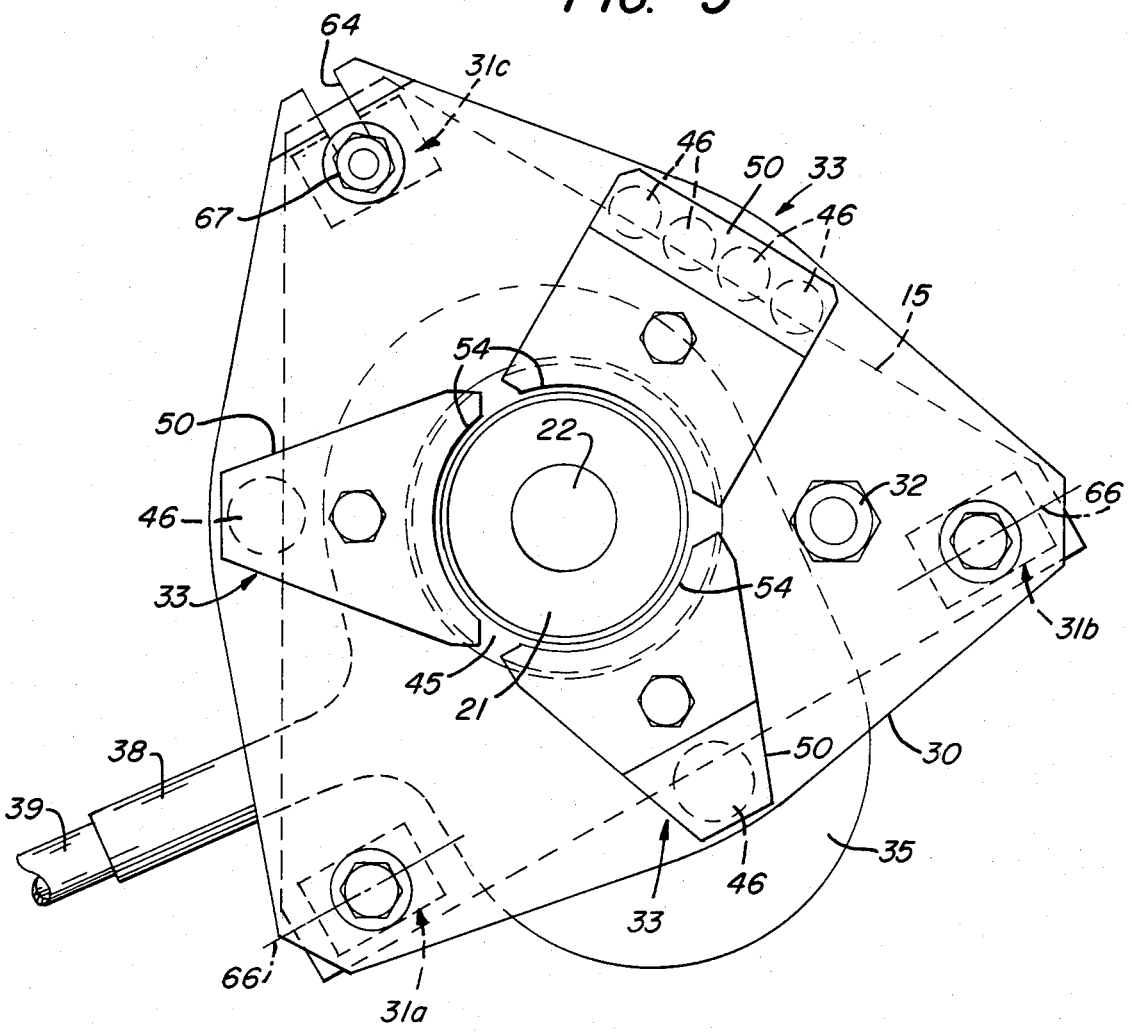
FIG. 5 is an underneath view of the valve.

Valve members 20 and 21 in this example are of circular cross-section and have similar external shapes. Each member 20, 21 is of nozzle form and each is enlarged or flanged at one end. Valve member 20 constitutes an inlet nozzle which extends through an opening in the mounting plate 15 and fits into a recess 23 in the vessel outlet brick 14. Valve member 21 on the other hand serves as a discharge nozzle or collector. The enlarged or flanged ends 25, 26 of valve members 20, 21 have accurately flat and parallel faces which confront one another but are spaced apart. Valve member 22 is sandwiched between the confronting flat faces of the other valve members 20, 21 and its function is to control metal flow. To this end, valve member 22 is an elongated, planar refractory plate of oval outline—see FIG. 2. The valve plate 22 has parallel, accurately flat opposite surfaces to form a leak-tight assembly with the valve members 20, 21, when all three valve members are urged into co-operating facial contact with one another by upward biasing spring means described later. The valve member 22 has an orifice 27 towards one end thereof. The valve is open to metal flow when the valve member 22 is moved, between the other two valve members, to register its orifice 27 with bores 28, 29 of the latter members, as shown in FIG. 1. Conversely, the valve is closed when the orifice 27 is moved out of registry with the bores 28, 29 and an imperforate portion of valve member 22 beside the orifice 27 is interposed between the bores. When operating the valve 10, only valve member 22 is moved, the other members 20, 21 being stationarily mounted in the valve.

The valve members 20, 21 need not have exactly the same form as shown, and indeed they need not be substantially identical with one another. Their manufacture by pressing or casting is simplified if they have the same external form, however. Their precise forms are generally immaterial so far as concerns this invention, but each should possess contact faces of substantial area for engagement with the movable valve member 22.

The valve 10 includes a support plate 30 suspended from the mounting plate 15 by a plurality of attachments 31. The support plate 30 carries the movable valve member 22 by way of an upstanding pivot 32, and moreover indirectly supports the lower valve member 21 via upward biassing spring means 33. Valve member 22 is received in a correspondingly-shaped seating 34 in an intermediate plate 35, which terminates at one end in a bearing bush 36 embracing the pivot 32.

Thanks to the pivot arrangement 32, 36, the intermediate plate 35 can be swung to and fro in a plane normal to the aligned axes of bores 28, 29. Thus, suitable swinging movements of the plate 35 will be responsible for displacing the valve member 22 relative to the other valve members 20, 21 for opening and closing the valve 10.

The plate 35 protrudes outwardly beyond the mounting and support plates 15, 30 for operating force to be applied externally thereto. Thus, opposite the pivot arrangement 32, 36 the plate has an outwardly-extending lever portion 38. This lever portion 38 is socketed at 39, for receipt of a crowbar by means of which the valve can be opened and closed. The length of the crowbar will be such as to attain whatever mechanical advantage may be needed for the operator comfortably to displace the valve member 32 against prevailing frictional resistance between the valve members. Two stops 37 engageable by the lever portion 38 limit swinging movement of plate 35 and valve member 22 to, say, 45° of arc. The stops 37 can project downwardly from the mounting plate 15 or upwardly from the support plate 30.

The valve 10 is primarily meant for controlling flow from small ladles, when it will be operated manually. However, the design is capable of being scaled up. Then, hydraulic, pneumatic, electrical or mechanical drives may be coupled suitably to the lever portion 38.

In use, wear may occur at the pivot arrangement 32, 36 which may then become sloppy. Wear may also occur of the sliding contact faces between the three valve members. Any such wear could allow the planar valve member 22 to rock about axes normal to the pivot axis 40. Initial rocking could allow molten metal to penetrate and freeze between the sliding contact faces. Once this happens, further penetration can occur. This has two consequences. Firstly, damage to the costly refractory valve members will take place. Secondly, and more importantly, dangerous break-out of molten metal may happen.

More significantly, the foundry operative could quite easily cause rocking and break-out if he operated the valve carelessly. The length of the operating crowbar may well be 6 feet (ca. 2 m) in length. With such a lengthy lever arm, the operator who inadvertently bears down thereon could force the intermediate plate 35 and valve members 22, 21 downwardly away from the valve member 20 against the upward biassing of the spring means 33. Such an action could cause break-out in the absence of suitable countermeasures.

In the illustrated embodiment, rocking is unlikely about an axis in the plane of valve member 22 and passing through the pivot arrangement 32, 36. The diameters of the flanged ends of valve members 20, 21 and the length of valve member 22 will ordinarily be enough to prevent this rocking action.

Rocking about an axis normal to the axis just mentioned, possibly caused by an operator leaning on the crowbar, is positvely prevented in the illustrated embodiment. To this end, the lever portion 38 of the intermediate plate 35 moves in a vertically-narrow slot 41 formed between the peripheries of the mounting and support plates 15 and 30. At least one of these plates has a jaw member 42 welded thereto in part defining the slot 41. A second jaw may be welded to the other plate. As illustrated, however, the periphery of plate 30 itself forms a second slot-defining jaw. A packing piece 43 is welded to the lever portion 38. The thickness of the slot 41 and the combined thickness of the lever portion and packing piece 43 are such as to leave a small clearance for easy movement of the intermediate plate when the valve is in its operative condition as shown in FIG. 1.

The spring means 33 serve to provide an upward biassing force on the lowermost valve member 21. This biases the valve members 20, 21, 22 into firm facial contact to safeguard against leakage. Force is applied to a shoulder 45 forming the underside of the flange of valve member 21 over a substantial part of its periphery by several spring means 33. As shown, there are three spring means 33 mounted on the support plate 30.

Each spring means comprises a spring or springs 46 each seated at one end in a pocket 47 in the underside of the support plate 30 adjacent its periphery. The lower end of each spring 46 bears downwardly upon a seat 48 therefor in a rocker plate 50. The rocker plate 50 is mounted on a stud 51 depending from the support plate 30 and held in place by a crown nut 52. The rocker plate 50 has a hollow lead-in 53 to an aperture therein which passes the stud, so that the lead-in and crown nut coact to form a bearing upon which plate 50 can rock. At its opposite end from the seat 48, inwardly of the stud 51, the rocker plate has an upstanding lip which abuts the shoulder 45 of valve member 21. The lip 54 has a substantial arcuate length to engage a significant portion of the circumferential length of the shoulder 45. Thus the forces exerted on valve member 21 by the spring means are spread evenly therearound. It will be appreciated that the spring 46 thrusts down on the seat 48 and thus biases the lip 54 upwardly against the valve member 21.

The upward force exerted by the spring means 33 on the valve member 21 can be finely adjusted and balanced by means of the crown nuts, e.g. using a torque wrench.

Each spring means can incorporate one or more springs 46. Compression coil springs, Bellville washers or gas-filled spring devices can be used.

Service conditions are so aggressive that deterioration of the refractory valve members 20, 21 and 22 is quite rapid. Deterioration is accelerated when throttling a metal stream, as is well known. Frequent inspection and replacement of the refractories is necessary, therefore.

In the past, disassembly of valves has often been quite troublesome and resetting of the spring biassing force has been necessary each time valves are reassembled. The present design aims to ease these operating difficulties.

Accordingly, the two plates 15 and 30 are secured together by a plurality of identical clamp devices 31*a, b, c,* two of which serve as hinge means. The clamp devices 31*a* to *c* and distance pieces 60 of predetermined dimensions coact to affix the plate 30 rigidly to the mounting plate 15 always at a preset distance therefrom.

The clamp devices are identical and comprise downwardly-open clevises 61 welded to the mounting plate 15, eyebolts 62, and clevis pins 63 pivotally attaching the eyebolts to the clevises. The eyebolts 62 of clamp devices 31*a* and *b* pass through apertures in the associated distance pieces 60 and the support plate. The eyebolt of clamp device 31*c,* however, extends through an open-ended slot 64 opening to the periphery of the support plate 30. The clevis pins 63 of clamp devices 31*a* and *b* are aligned on a common axis 66 so that these devices together form a hinge. Thanks to this hinge, when the clamp device 31*c* is released (by slackening off its nut 67) and swung clear of its slot 64, the support plate 30 can swing downwards away from the mounting plate 15 to expose the valve members for inspection or replacement. Reassembly is the reverse of the opening operation just described.

The distance pieces 60 are welded to the support plate 30. They and clevises 61 are so dimensioned that upon reassembling the valve the support plate 30 is located at a fixed, predetermined spacing from the mounting plates when the nuts 67 are fully tightened, drawing the clevises 61 into abutment with their distance pieces 60. Thanks to this arrangement, upon completion of reassembly the springs 46 will all be re-loaded to a preset operating level or close thereto. Any final adjustment can be made using the nuts 52 of the spring means 33. No readjustment should be necessary if inspection establishes that the refractory valve members 20, 21, 22 are still serviceable. Moreover, thanks to the said dimensioning, the correct gap between the opposed jaws forming the slot 41 for lever portion 38 will always be maintained whenever the valve is reassembled. Thus, the ability of the valve to resist rocking e.g. through careless use of the crowbar will remain unaffected by disassembling and reassembling the valve.

As illustrated, the plates 15 and 30 are substantially triangular in shape and have three hinge/clamp devices 31. Other shapes are possible and more than three devices 31 may be provided. In suitable cases, the hinge means can be provided by but one of the said devices 31.

What is claimed is:

1. A sliding gate valve for use in the pouring of molten metals including a mounting plate, a support plate, and orificed refractory valve bodies carried by each of the respective plates and being spring pressed into mutual sealing contact, one of said valve bodies serving as a gate and being movable with respect to the other valve body for controlling the flow of metal through the valve, and means forming attachments disposed at spaced locations about the valve for releasably securing said plates together, each of said attachments comprising a clevis mounted on one of said plates a pivot pin being received in said clevis and an eyebolt having its eye at one end pivotally connected to said pivot pin and a shaft extending through an associated opening in the other of said plates, said shaft being threaded and receiving a nut, at least two of said clevises being positioned to place the pivot pins thereof in axial alignment; and the eyebolt in the remainder of said clevises being swingably releasable from said other plate permitting said plates to be pivotally spread to expose said valve bodies for inspection or replacement.

2. A valve according to claim 1 in which said clevises all include an abutment surface spaced a predetermined, substantially uniform distance from said one plate for bearing engagement with the facing surface of said other plate when said nuts are tightened.

3. A valve according to claim 2 in which each of said plates carry stationary valve bodies and including a frame connected to said support plate for pivotal movement about an axis perpendicular thereto, said frame being positioned intermediate said stationary valve bodies and carrying said movable valve body.

4. A valve according to claim 3 in which said plates are mutually spaced forming a narrow slot therebetween and said frame including an actuating lever slidingly received in said slot and coacting therewith to resist inadvertent displacement of said frame-mounted valve body.

5. A valve according to any one of claims 1 through 4 including a plurality of spring means carried by said support plate in surrounding relation to the valve body therein and each including a force-transmitting rocker, a spring for biasing one end of said rocker outwardly from said support plate and a lip at the other end of said rocker for engagement with said valve body.

6. A valve body according to claim 5 including a crown nut forming the fulcrum for said rocker, said nut threadedly connecting said rocker to said support plate and being operative for adjusting the force transmitted by said rocker to the engaged valve body.

* * * * *